US009053669B2

(12) United States Patent
Han

(10) Patent No.: US 9,053,669 B2
(45) Date of Patent: Jun. 9, 2015

(54) APPARATUS FOR SCAN DRIVING INCLUDING SCAN DRIVING UNITS

(75) Inventor: Sam-Il Han, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 787 days.

(21) Appl. No.: 12/939,814

(22) Filed: Nov. 4, 2010

(65) Prior Publication Data

US 2011/0109599 A1 May 12, 2011

(30) Foreign Application Priority Data

Nov. 6, 2009 (KR) ..... 10-2009-0107224

(51) Int. Cl.
*G09G 3/32* (2006.01)

(52) U.S. Cl.
CPC ..... *G09G 3/3266* (2013.01); *G09G 2300/0852* (2013.01); *G09G 2300/0876* (2013.01)

(58) Field of Classification Search
CPC ..... G09G 2300/0842; G09G 2320/043; G09G 3/3233
USPC ..... 345/82
See application file for complete search history.

(56) References Cited

U.S. PATENT DOCUMENTS

2005/0264493 A1* 12/2005 Shin ..... 345/76
2007/0063950 A1* 3/2007 Shin ..... 345/92
2007/0070009 A1* 3/2007 Mori et al. ..... 345/89
2009/0225068 A1* 9/2009 Jeong et al. ..... 345/211
2009/0251392 A1* 10/2009 Kim et al. ..... 345/76

FOREIGN PATENT DOCUMENTS

JP 2008-040445 2/2008
KR 10-2007-0117979 12/2007

* cited by examiner

*Primary Examiner* — Jonathan Blancha
(74) *Attorney, Agent, or Firm* — Christie, Parker & Hale, LLP

(57) ABSTRACT

A scan driving apparatus, includes a first scan driving unit coupled to a second scan driving unit, the first scan driving unit receives a first start signal, a first clock signal, a second clock signal, and sequentially outputs the first clock signal as a first scan, and outputs the first boost clock signal as a first boost signal, and the second scan driving receives the first clock signal, the second clock signal, a second boost clock signal, and the first scan signal as a second start signal, to sequentially output the second clock signal as a second scan signal, and sequentially outputs the second boost clock signal as a second boost signal.

14 Claims, 7 Drawing Sheets

APPARATUS FOR SCAN DRIVING INCLUDING SCAN DRIVING UNITS

CROSS-REFERENCE TO RELATED APPLICATION

This application claims priority to and the benefit of Korean Patent Application No. 10-2009-0107224 filed in the Korean Intellectual Property Office on Nov. 6, 2009, the entire content of which is incorporated herein by reference.

BACKGROUND

1. Field

Aspects of embodiments according to the present invention relate to a scan driving apparatus.

2. Description of the Related Art

Display devices include a display panel constituted by a plurality of pixels arranged in a matrix. The display panel includes a plurality of scan lines extending in a row direction and a plurality of data lines extending in a column direction. The plurality of scan lines and the plurality of data lines cross each other. Each of the plurality of pixels is driven by a scan signal and a data signal transmitted from the corresponding scan line and data line.

A light emitting display device may be classified as a passive matrix type or an active matrix type according to a driving scheme of the pixels. In an active matrix type, unit pixels are selectively lighted in accordance with the resolution, contrast, and operation speed of the display device.

A display device is used in portable information terminals such as a personal computer, a mobile phone, a personal data assistant (PDA), or the like, or monitors of various types of information display equipment. Various display devices include liquid crystal displays (LCDs) using a liquid crystal panel, organic light emitting display devices using an organic light emitting device, plasma display panels (PDPs) using a plasma panel, etc. An organic light emitting display device having excellent emission efficiency, luminance, and viewing angle as well as rapid response speed has attracted public attention.

In an active matrix organic light emitting display device, a data signal is written in synchronization with a scan signal transmitted to a pixel. The written data signal may be compensated by a boost signal. In a pixel performing a light emitting operation by receiving the scan signal, the scan signal should be applied through the scan line and the boost signal should be applied through the boost signal line. Therefore, the organic light emitting display device should include a scan driver that can drive the scan signal and a boost driver that can drive the boost signal. However, including both a scan driver and a boost driver, increases the relative dimensions of the drivers with respect to the entire panel dimensions.

The above information disclosed in this Background section is only for enhancement of understanding of the background of the embodiments of the invention and therefore it may contain information that does not form the prior art that is already known in this country to a person of ordinary skill in the art.

SUMMARY

Accordingly, an aspect of the present invention provides a display device that may be configured to reduce the dimensions of drivers (e.g., size).

According to one embodiment, a scan driver includes a first scan driving unit configured to receive a first start signal, a first clock signal, a second clock signal, and a first boost clock signal, to sequentially output the first clock signal as a first scan signal having a first period in accordance with the first start signal applied in response to the second clock signal, and to sequentially output the first boost clock signal as a first boost signal having the first period; and a second scan driving unit coupled to the first scan driving unit, the second scan driving unit configured to receive the first clock signal, the second clock signal, a second boost clock signal, and the first scan signal as a second start signal, to sequentially output the second clock signal as a second scan signal having a second period in accordance with the second start signal applied in response to the first clock signal, and to sequentially output the second boost clock signal as a second boost signal having the second period.

A first scan driving unit may include a scan signal generator configured to receive the first clock signal and the second clock signal and output the first clock signal as the first scan signal in accordance with the first start signal applied by the second clock signal; and a boost output terminal configured to receive the first boost clock signal and output the first boost clock signal as the first boost signal in accordance with the first start signal applied in response to the second clock signal.

The scan signal generator of the first scan driving unit may include: a first transistor comprising a first terminal for receiving the first clock signal, a gate terminal for receiving the first start signal, and a second terminal for outputting the first scan signal; a first capacitor coupled between the gate terminal of the first transistor and the second terminal of the first transistor; and a second transistor comprising a first terminal coupled with the gate terminal of the first transistor, a gate terminal for receiving the second clock signal, and a second terminal for receiving the first start signal.

The boost output terminal of the first scan driving unit may include: a third transistor comprising a first terminal for receiving the first boost clock signal, a gate terminal coupled to the gate terminal of the first transistor, and a second terminal for outputting the first boost clock signal; and a second capacitor coupled between the gate terminal of the third transistor and the second terminal of the third transistor.

The scan signal generator of the first scan driving unit may further include: a fourth transistor comprising a first terminal coupled with a first power source, a gate terminal, and a second terminal coupled with the second terminal of the first transistor; and a fifth transistor comprising a first terminal coupled with the gate terminal of the fourth transistor, a gate terminal for receiving a first initial signal, and a second terminal coupled with a second power source, wherein the first power source is configured to generate a higher voltage level than the second power source.

The boost output terminal of the first scan driving unit may further include, a sixth transistor comprising a first terminal coupled with the first power source, a gate terminal coupled with the first terminal of the fifth transistor, and the second terminal coupled with the second terminal of the third transistor.

The first initial signal may become a pulse of an activation level before the start signal becomes a pulse of an activation level.

The scan signal generator of the first scan driving unit may further include: a seventh transistor comprising a first terminal coupled with the first power source, a gate terminal for receiving the first start signal, and a second terminal coupled with the first terminal of the fifth transistor; an eighth transistor comprising a first terminal coupled with the first power source, a second terminal, and a gate terminal coupled with the second terminal of the seventh transistor; and a ninth transistor comprising a first terminal coupled with the second terminal of the eighth transistor, a gate terminal coupled with the gate terminal of the eighth transistor, and a second terminal coupled with the gate terminal of the first transistor.

A second scan driving unit may include: a scan signal generator for receiving the first clock signal, and the second clock signal, and for outputting the second clock signal as the second scan signal in accordance with the second start signal applied in response to the first clock signal; and a boost output terminal for receiving the second boost clock signal and for outputting the second boost clock signal as the second boost signal in accordance with the second start signal applied in response to the first clock signal.

The scan signal generator of the second scan driving unit may include: a tenth transistor comprising a first terminal for receiving the second clock signal, a gate terminal for receiving the second start signal according to the first clock signal, and a second terminal for outputting the second scan signal; a third capacitor coupled with the gate terminal and the second terminal of the tenth transistor; and an eleventh transistor comprising a first terminal coupled with the gate terminal of the tenth transistor, a gate terminal for receiving the first clock signal, and the second terminal for receiving the second start signal.

The boost output terminal of the second scan driving unit may include: a twelfth transistor comprising a first terminal for receiving the second boost clock signal, a gate terminal for receiving the second start signal applied by the first clock signal, and a second terminal configured to output the second boost clock signal; and a fourth capacitor coupled with the gate terminal and the second terminal of the twelfth transistor.

The scan signal generator of the second scan driving unit further includes: a thirteenth transistor comprising a first terminal coupled with the first power source and a second terminal coupled to the second terminal of the tenth transistor; and a fourteenth transistor comprising a first terminal coupled with the gate terminal of the thirteenth transistor, a gate terminal for receiving a second initial signal, and a second terminal coupled with the second power source.

The boost output terminal of the second scan driving unit may further include a fifteenth transistor comprising a first terminal coupled with the first power source, a gate terminal coupled with the first terminal of the fourteenth transistor, and a second terminal coupled with the second terminal of the twelfth transistor.

The second initial signal becomes a pulse of an activation level before the second start signal becomes a pulse of an activation level.

The scan signal generator of the second scan driving unit may further include: a sixteenth transistor comprising a first terminal coupled with the first power source, a gate terminal for receiving the second start signal, and a second terminal coupled with the first terminal of the fourteenth transistor; a seventeenth transistor comprising a first terminal coupled with the first power source, a second terminal, and a gate terminal coupled with the second terminal of the sixteenth transistor; and an eighteenth transistor comprising a first terminal coupled with the second terminal of the seventeenth transistor, a gate terminal coupled with the gate terminal of the seventeenth transistor, and a second terminal coupled with the gate terminal of the tenth transistor.

The first scan signal may be a frame start signal which may be applied to display an image of one frame.

The first boost clock signal may be delayed from the first clock signal by a first time period.

Another embodiment provides a scan driving apparatus that includes: a scan signal generator for receiving a first clock signal and a second clock signal and outputting the first clock signal as a first scan signal in accordance with a first start signal applied in response to a second clock signal; and a plurality of boost output terminals for receiving first to n-th boost clock signals and for outputting the first to n-th boost clock signals as first to n-th boost signals, respectively, in accordance with the first start signal applied in response to the second clock signal, wherein the second to n-th boost clock signals of the plurality of first to n-th boost clock signals are delayed from a previous one of the plurality of first to n-th boost clock signals by a first time delay.

The scan signal generator may include: a first transistor comprising a first terminal for receiving the first clock signal, a gate terminal for receiving the first start signal, and a second terminal for outputting the first scan signal; a first capacitor coupled with the gate terminal and the second terminal of the first transistor; and a second transistor comprising a first terminal coupled with the gate terminal of the first transistor, a gate terminal for receiving the second clock signal, and a second terminal for receiving the first start signal.

A boost output terminal of the plurality of boost output terminals may include: a third transistor comprising a first terminal for receiving a corresponding boost clock signal from among the first to n-th boost clock signals, a gate terminal for receiving the first start signal, and a second terminal for outputting a respective one of a first to n-th boost signal; and a second capacitor coupled with the gate terminal and the second terminal of the third transistor.

The scan signal generator may further include: a fourth transistor comprising a first terminal coupled with a first power source, a gate terminal, and a second terminal coupled with the second terminal of the first transistor; and a fifth transistor comprising a first terminal coupled with the gate terminal of the fourth transistor, a gate terminal for receiving a first initial signal, and a second terminal coupled with a second voltage source, wherein the first power source is configured to generate a higher voltage level than the second power source.

The boost output terminal of the plurality of boost output terminals may further include a sixth transistor comprising a first terminal coupled with the first power source, a gate terminal coupled with the first terminal of the fifth transistor, and a second terminal coupled with the second terminal of the third transistor.

The first initial signal may becomes a pulse of an activation level before the first start signal becomes a pulse of an activation level.

The scan signal generator may further include: a seventh transistor comprising a first terminal coupled with the first voltage source, a gate terminal for receiving the first start signal, and a second terminal coupled with the first terminal of the fifth transistor; an eighth transistor comprising a first terminal coupled with the first voltage source, a second terminal, and a gate terminal coupled with the second terminal of the seventh transistor; and a ninth transistor comprising a first terminal coupled with the second terminal of the eighth transistor, a gate terminal coupled with the gate terminal of the eighth transistor, and a second terminal coupled with the gate terminal of the first transistor.

The first boost clock signal may be delayed from the first clock signal by a first period. Additionally, the first period may be set by a user.

According to an embodiment a scan driving apparatus can generate both a plurality of scan signals and a plurality of boost signals. As a result, it is possible to eliminate an additional boost driver for generating the boost signal, and to reduce the dimensions of a driver and simplify circuit components provided in the scan driving apparatus.

According to another embodiment a scan driving apparatus can generate both one scan signal and a plurality of boost signals in one scan driving apparatus. As a result, it is possible to eliminate an additional boost driver for generating the boost signal, and to reduce the dimensions of a driver and simplify circuit components provided in the scan driving apparatus.

DETAILED DESCRIPTION

Figure 1:
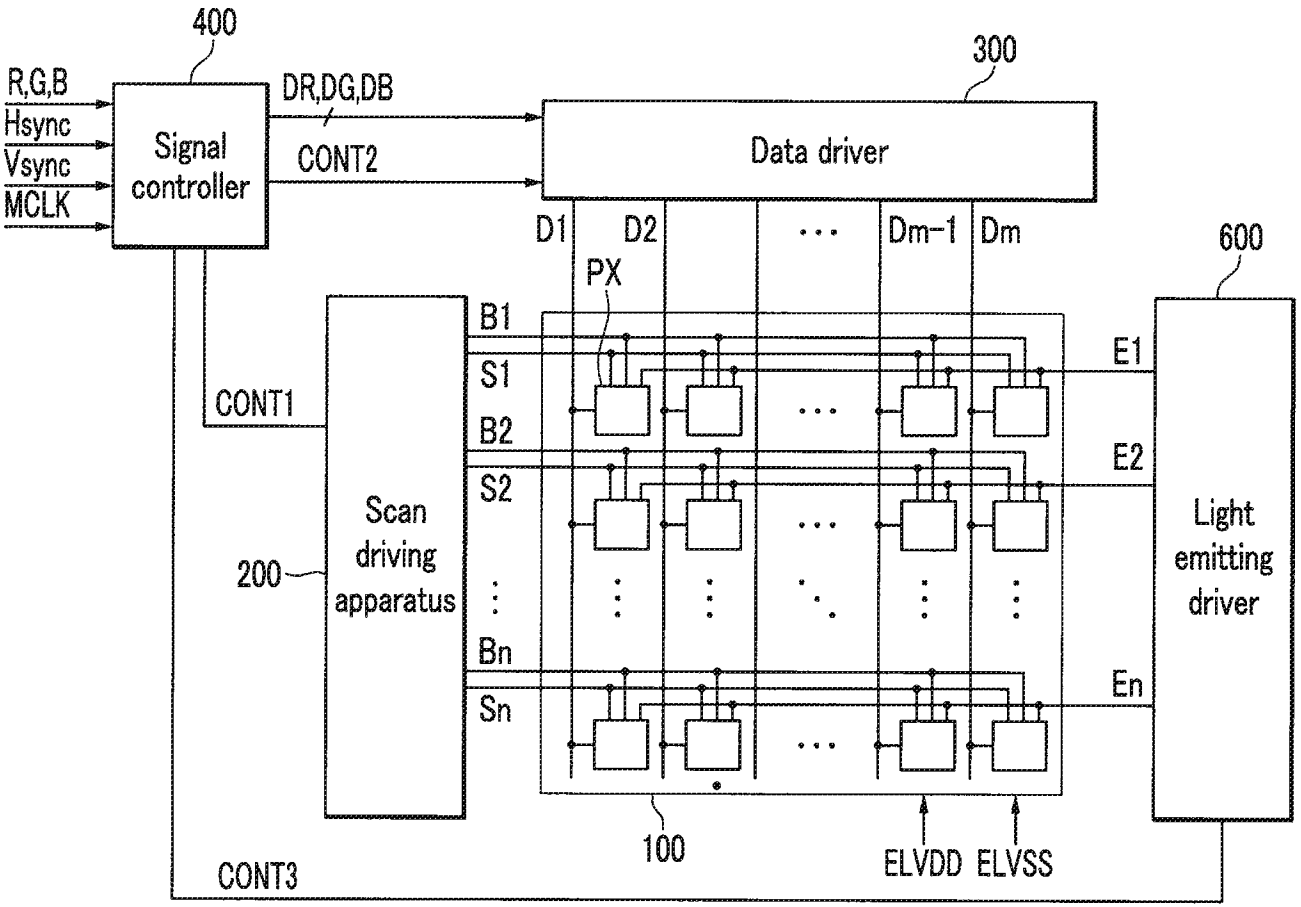
FIG. 1 is a block diagram illustrating a display device including a scan driving apparatus according to an exemplary embodiment of the present invention.

Hereinafter, certain exemplary embodiments will be described with reference to the accompanying drawings. The drawings and description are to be regarded as illustrative in nature and not restrictive. Furthermore, like reference numerals designate like elements throughout the specification. As those skilled in the art would realize, the described embodiments may be modified in various different ways, all without departing from the spirit or scope of the present invention.

In this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram illustrating a display device including a scan driving apparatus according to an exemplary embodiment of the present invention. The display device of FIG. 1 may be an organic light emitting display device.

Referring to FIG. 1, the display device includes a panel 100, a scan driving apparatus 200 (e.g., a scan driver), a data driver 300, a signal controller 400, and a light emitting driver 600. The panel 100 includes a plurality of signal lines S1 to Sn, B1 to Bn, E1 to En, and D1 to Dm, and a plurality of pixel circuits PX that are coupled to the signal lines and are arranged substantially in a matrix when viewing from an equivalent circuit perspective.

The signal lines S1 to Sn, B1 to Bn, E1 to En, and D1 to Dm include a plurality of scan lines S1 to Sn that transfer scan signals, a plurality of boost lines B1 to Bn that transfer boost signals, a plurality of emission signal lines E1 to En that transfer emission signals, and a plurality of data lines D1 to Dm that transfer data signals. The scan lines S1 to Sn, the boost lines B1 to Bn, and the emission signal lines E1 to En extend substantially in a row direction and are substantially parallel to each other, and the data lines D1 to Dm extend substantially in a column direction and are substantially parallel to each other.

Figure 2:
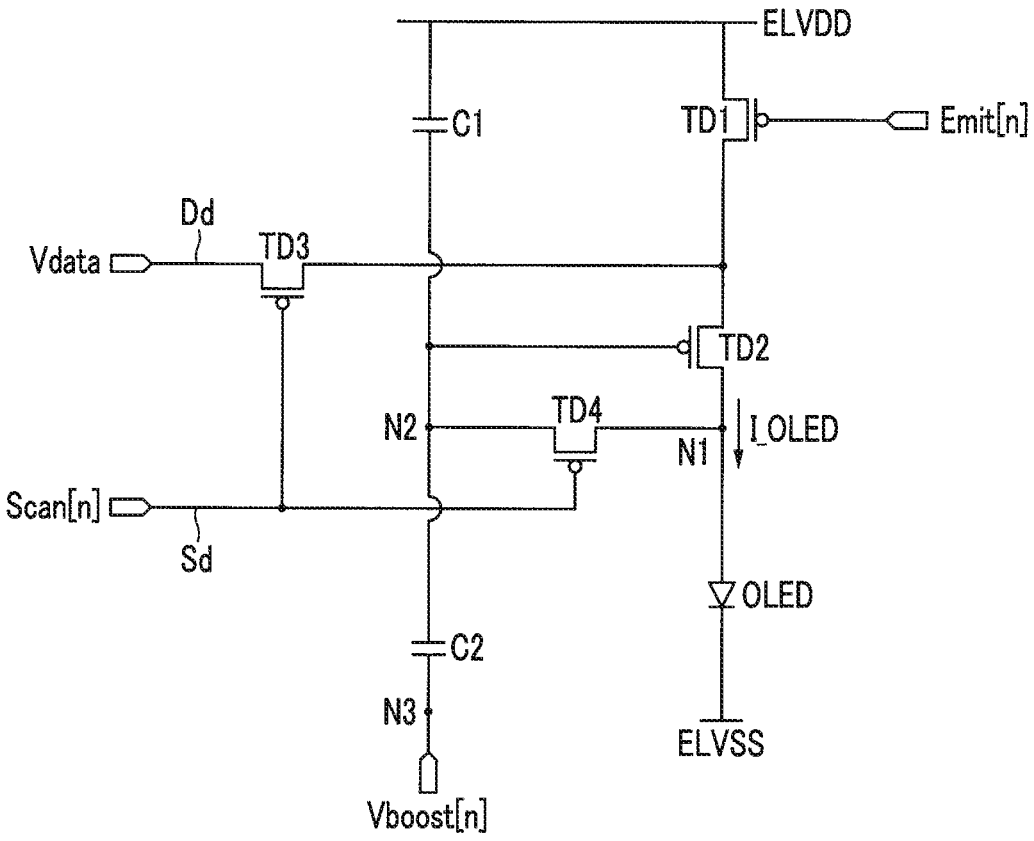
FIG. 2 is a diagram illustrating a pixel circuit that can be included in the display device of FIG. 1.

FIG. 2 is a diagram illustrating a pixel circuit that can be included in the display device illustrated in FIG. 1;

Referring to FIG. 2, one pixel circuit PX includes an organic light emitting diode (OLED), a light emission control transistor TD1, a driving transistor TD2, capacitors C1 and C2, a switching transistor TD3, and a scan driving transistor TD4.

The OLED may receive a current I_OLED that flows on the driving transistor TD2, and emit light in accordance with the received current I_OLED. The driving transistor TD2 includes a source terminal coupled with a first driving voltage source ELVDD through the light emission control transistor TD1, a drain terminal coupled with an anode terminal of the OLED, and a gate terminal coupled with a second node N2. The driving transistor TD2 allows a driving current I_OLED having magnitude that varies in accordance with a voltage applied between the gate terminal and the source terminal to flow to the OLED.

The switching transistor TD3 includes a gate terminal coupled with a scan line Sd, a source terminal coupled with a data line Dd, and a drain terminal coupled with the source terminal of the driving transistor TD2. The switching transistor TD3 performs a switching operation in response to a scan signal Scan[n] applied through the scan line Sd. When the scan signal Scan[n] is applied to turn on the switching transistor TD3, a data signal Vdata applied through the data line Dd is transferred to the source terminal of the driving transistor TD2.

The capacitor C1 is coupled between the gate terminal of the driving transistor TD2 and the first driving voltage source ELVDD. The capacitor C1 is charged with a voltage corresponding to a difference between the data signal Vdata applied to the gate terminal of the driving transistor TD2 and the first driving voltage source ELVDD, and maintains the difference voltage even after the switching transistor TD3 is turned off.

The capacitor C2 is coupled between the gate terminal of the driving transistor TD2 and a supply terminal of a boost signal Vboost[n]. The terminals of the capacitor C2 are coupled to the second node N2 and a third node N3 (i.e., the supply terminal of the boost signal Vboost[n]), respectively. When the boost signal Vboost[n] increases, an incremental amount of voltage of the boost signal Vboost[n] is distributed in accordance with a ratio of capacitance between the capacitor C1 and the capacitor C2, and the voltage of the second node N2 increases in accordance with the distributed voltage.

The light emission control transistor TD1 includes a source terminal coupled with the first driving voltage source ELVDD, a drain terminal coupled with the source terminal of the driving transistor TD2, and a gate terminal that receives an emission signal Emit[n] (e.g., emission control signal). The light emission control transistor TD1 is turned on or off in response to the emission signal Emit[n] applied to the gate terminal. The light emission control transistor TD1 is turned off while the switching transistor TD3 is turned on to supply the data signal Vdata.

When the scan signal Scan[n] is applied to the gate of the switching transistor TD3 at low logic level, the data signal Vdata is applied to the source terminal of the driving transistor TD2. In addition, since the scan driving transistor TD4 is turned on to diode-couple the driving transistor TD2, a voltage difference found by subtracting an absolute value of a threshold voltage of the driving transistor TD2 from the data signal applied to the source terminal thereof is supplied to the drain terminal and the gate terminal of the driving transistor TD2. In addition, when the boost signal Vboost[n] increases, the voltage of the gate terminal of the driving transistor TD2 increases (e.g., by a predetermined voltage) corresponding to the incremental amount of the voltage of the boost signal Vboost[n].

In addition, when the light emission control transistor TD1 is turned on, the driving current I_OLED flows through the driving transistor TD2 by a voltage corresponding to a voltage difference between the source terminal and the gate terminal of the driving transistor TD2 to allow the OLED to emit light.

Like the pixel circuit shown in FIG. 2, the display device using the boost signal additionally requires a boost driver for supplying the boost signal Vboost[n].

The display device including the scan driving apparatus according to one exemplary embodiment configures the scan driver and the boost driver as one driver to remove the boost driver for generating the boost signal Vboost[n]. Then, it is possible to reduce the dimensions or size of by the drivers 200, 300, and 600 in the display device.

Hereinafter, a scan driving apparatus 200 in which the scan driver and the boost driver are formed as one driver will be described in detail with reference to FIGS. 3 to 7.

Figure 3:
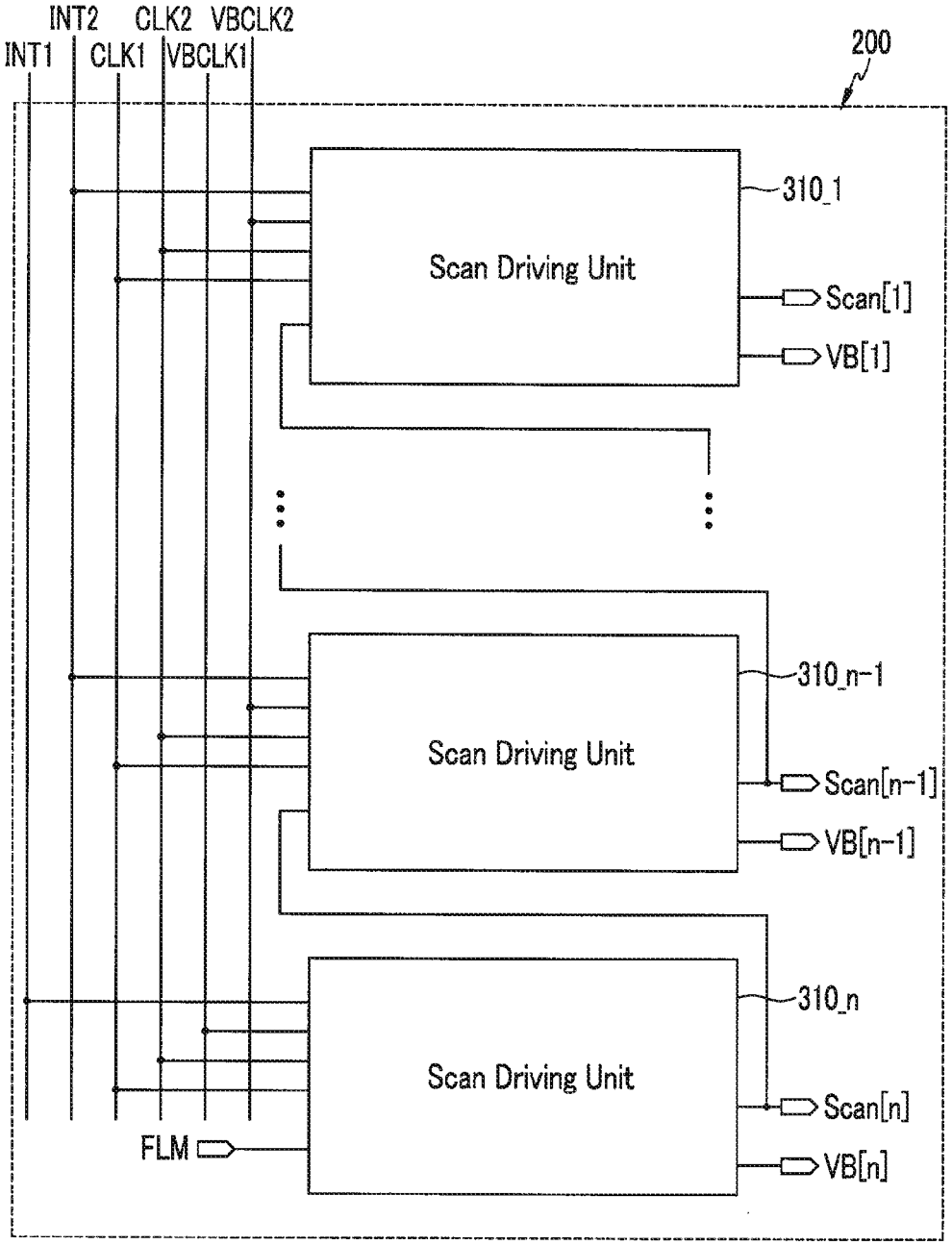
FIG. 3 is a diagram illustrating a scan driving apparatus according to an exemplary embodiment of the present invention.
Figure 4:
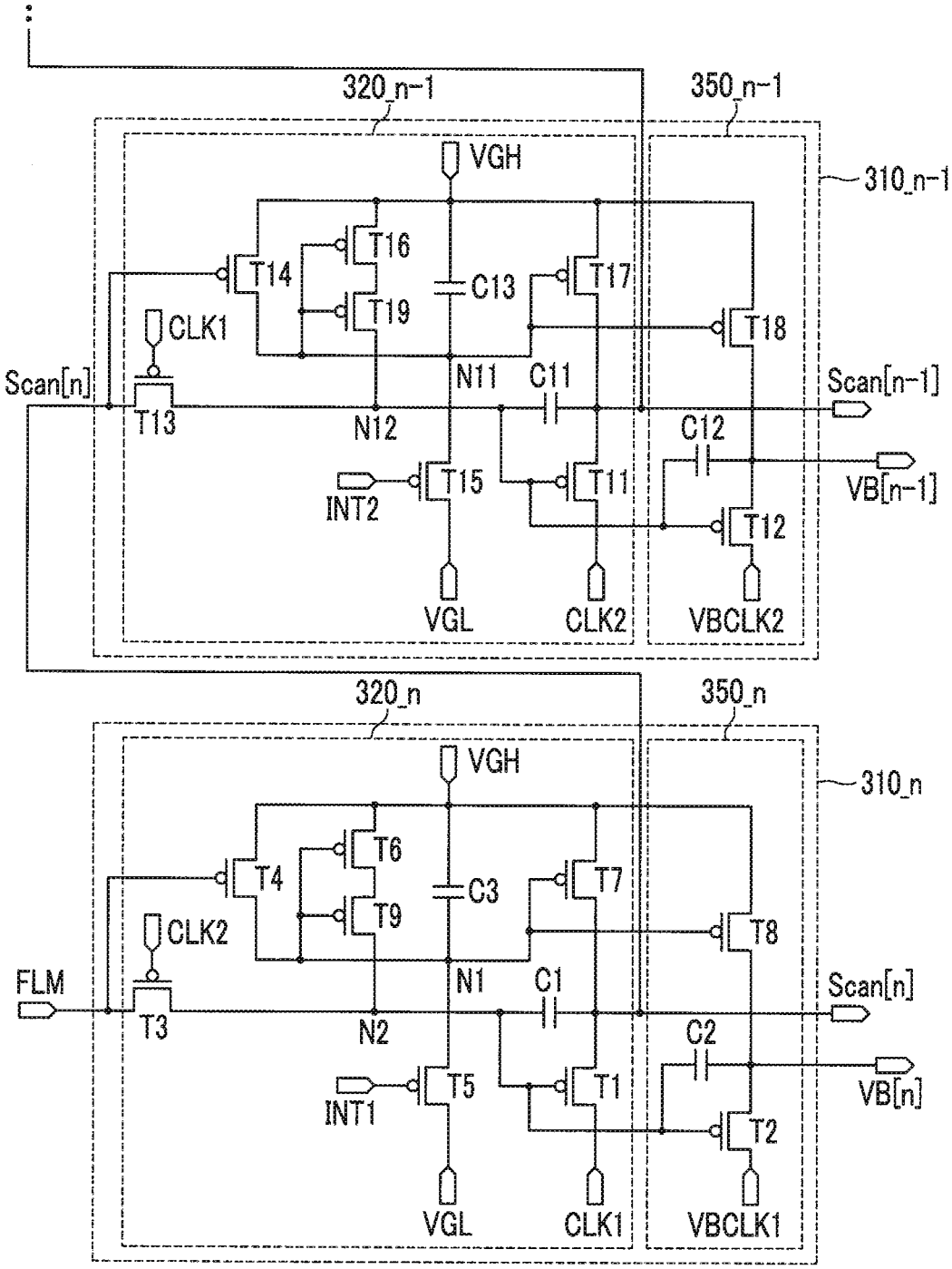
FIG. 4 is a diagram more specifically illustrating the scan driving apparatus illustrated in FIG. 3.

FIG. 3 is a diagram illustrating a scan driving apparatus according to an exemplary embodiment of the present invention. FIG. 4 is a diagram more specifically illustrating the scan driving apparatus illustrated in FIG. 3.

Hereinafter, referring to FIGS. 3 and 4, the scan driving apparatus according to an exemplary embodiment of the present invention will be described in detail.

Referring to FIG. 3, the scan driving apparatus 200 according to an exemplary embodiment includes a plurality of scan driving units 310_1 to 310_*n* that generate the plurality of scan signals and the plurality of boost signals. The boost signal (i.e., VB[n]) shown in FIGS. 3 to 7 is equivalent to the "Vboost[n]" signal shown in FIG. 2.

When the panel 100 includes n pixel circuits PX in the column direction as shown in FIG. 1, the scan driving apparatus 200 may include n scan driving units 310_1 to 310_*n*. In FIG. 3, for brevity, only three scan driving units 310_1, 310_*n*−1, and 310_*n* are illustrated. The first scan driving unit 310_1 to the n-th scan driving unit 310_*n* supply a plurality of scan signals Scan[1] to Scan[n] to the scan signal lines S1 to Sn, as shown in FIG. 1, respectively. In addition, the first scan driving unit 310_1 to the n-th scan driving unit 310_*n* supply a plurality of boost signals VB[1] to VB[n] to the boost signal lines B1 to Bn, as shown in FIG. 1, respectively.

Referring to FIG. 3, the n-th scan driving unit 310_*n* outputs the scan signal Scan[n] and the boost signal VB[n], and an (n−1)-th scan driving unit 310_*n*−1 receives the scan signal Scan[n] outputted from the n-th scan driving unit 310_*n* and outputs a scan signal Scan[n−1] and a boost signal VB[n−1]. That is, an (i−1)-th scan driving unit (e.g., 310_*n*−1) is receives the scan signal (e.g., Scan[n]) outputted from an i-th scan driving unit (e.g., 310_*n*) which is a scan driving unit adjacent to the (i−1)-th scan driving unit, and outputs a scan signal Scan[i−1] (e.g., Scan [n−1]) and a boost signal VB[i−1] (e.g., VB[n−1]).

Hereinafter, it is assumed that n is an even number.

For example, in FIG. 3, a plurality of scan signals Scan[n], Scan[n−1], . . . , Scan[1] are generated and applied from the n-th scan signal line Sn through the first scan signal line S1. The display device illustrated in FIG. 1, which includes the scan driving apparatus 200 shown in FIG. 3, performs a scan operation from the scan signal line Sn to the scan signal line S1. However, the embodiments herein are not limited thereto, and the scan operation may alternatively be performed, e.g., from the scan signal line S1 to the scan signal line Sn.

FIG. 4 more specifically illustrates a scan driving apparatus as shown FIG. 3. Referring to FIG. 4, one scan driving unit (e.g., 310_*n*) includes a scan signal generator 320_*n* and a boost output terminal 350_*n*. Components of the plurality of scan driving units 310_1, 310_*n*−1, . . . , 310_*n* shown in FIG. 3 and connection relationships between the components are substantially the same. As described above, the scan driving unit can be receives the scan signal of the adjacent scan driving unit and generate a different scan signal. However, signals that are received by a plurality of first scan driving units positioned at even numbers from the bottom of FIG. 4 and a plurality of second driving units positioned at odd numbers among the plurality of scan driving units are different from each other (e.g., n is an even number and n−1 is an odd number).

Each of the plurality of first scan driving units is configured to receive an outputted scan signal from an adjacent second scan driving unit, a first clock signal CLK1 and a second clock signal CLK2, and a first initial signal INT1, to be described, and to generate the scan signal. In addition, the first scan driving unit receives a first boost clock signal VBCLK1 and generates the boost signal. However, the first scan driving unit (e.g., 310_*n*) receives a frame start signal FLM instead of an outputted scan signal of an adjacent second scan driving unit.

Each of the plurality of second scan driving units receives a scan signal from an adjacent second scan driving unit, the second clock signal CLK2 and the first clock signal CLK1, and a second initial signal INT2 to generate the scan signal. In addition, the second driving unit receives a second boost clock signal VBCLK2 and generates the boost signal.

Figure 5:
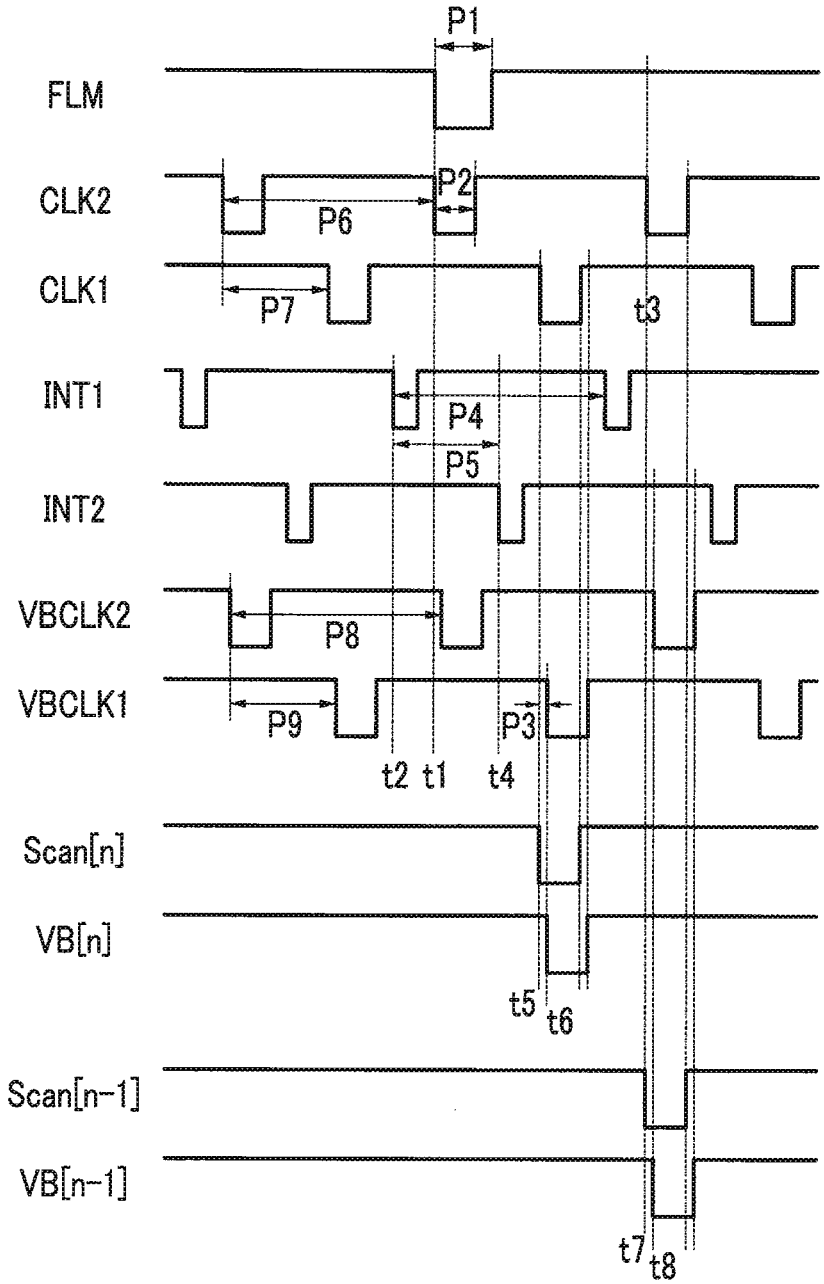
FIG. 5 is a timing diagram of signals for a scan driving apparatus as illustrated in FIG. 4.

FIG. 5 is a timing diagram of signals for a scan driving apparatus as illustrated in FIG. 4. Hereinafter, referring to FIG. 4 and FIG. 5, the first scan driving unit (e.g., 310_*n*) and the second scan driving unit (e.g., 310_*n*−1) will be described in detail.

The scan signal generator 320_*n* includes a first transistor T1, receives the frame start signal FLM and the first clock signal CLK1, and generates the scan signal Scan[n] for displaying an image of one frame. Referring to FIG. 5, in one embodiment the frame start signal FLM has a pulse of a low level during a first period P1 every cycle (e.g., a predetermined cycle). The cycle of the frame start signal FLM may also be referred to as a period of the frame start signal FLM and may vary in accordance with the product specifications of the display device or the panel.

The first transistor T1 includes a source terminal for receiving the scan signal Scan[n], a drain terminal for receiving the first clock signal CLK1, and a gate terminal for receiving the frame start signal FLM. When the frame start signal FLM is applied at a level to turn on the first transistor T1, the first transistor T1 outputs the first clock signal CLK1 as the scan signal Scan[n].

The boost output terminal 350_*n* includes a second transistor T2, and receives the first boost clock signal VBCLK1 and outputs the boost signal VB[n]. The second transistor T2 includes a source terminal for outputting the boost signal VB[n], a drain terminal for receiving the first boost clock signal VBCLK1, and a gate terminal for transporting the frame start signal FLM. The boost output terminal 350_*n* receives the first boost clock signal VBCLK1 and outputs the boost signal VB[n] according to the frame start signal FLM. When the frame start signal FLM is applied at a level to turn on the second transistor T2, the second transistor T2 outputs the first boost clock signal VBCLK1 as the boost signal VB[n].

The second clock signal CLK2, the first initial signal INT1, and the first clock signal CLK1 are applied to a gate terminal of a third transistor T3, a gate terminal of a fifth transistor T5, and the drain terminal which is one terminal of the first transistor T1 of the scan signal generator 320_n, respectively.

When the second clock signal CLK2 is applied at an activation level, the frame start signal FLM is transmitted to the gate of the first transistor T1 in response to the second clock signal.

The scan signal generator 320_n further includes the third transistor T3. The third transistor T3 includes a source terminal for receiving the frame start signal FLM, a gate terminal for receiving the second clock signal CLK2, and a drain terminal connected with the second node N2. The third transistor T3 is turned on or turned off depending on the logic level of the second clock signal CLK2 applied to the gate terminal.

The activation level of the second clock signal CLK2 will be a low logic level when the third transistor T3 is a P-type MOS transistor as shown in FIG. 4, and a high logic level when the third transistor T3 is an N-type MOS transistor.

When the third transistor T3 is turned on, the gate terminal of the first transistor T1 receives the frame start signal FLM. In addition, the drain terminal of the first transistor T1 receives the first clock signal CLK1. When the frame start signal FLM is applied at a level to turn on the first transistor T1, the first clock signal CLK1 is outputted from the first transistor T1 as the scan signal Scan[n]. When the first transistor T1 is the P-type MOS transistor, the frame start signal (FLM) to turn on the first transistor T1 has the low logic level.

The scan signal generator 320_n further includes the first capacitor C1 coupled between the gate terminal and the source terminal of the first transistor T1. When the third transistor T3 is turned off by the second clock signal CLK2 such that one terminal of the first capacitor C1 is floated, the voltage between the gate terminal and the source terminal of the first transistor T1 is maintained at the level when the first transistor T1 is turned on by the frame start signal FLM.

The boost output terminal 350_n further includes the second capacitor C2 coupled between the gate terminal and the source terminal of the second transistor T2. When the third transistor T3 is turned off such that one terminal of the second capacitor C2 is floated, the voltage between the gate terminal and the source terminal of the second transistor T2 is maintained at the level when the second transistor T2 is turned on by the frame start signal FLM. Therefore, the boost signal VB[n] can be outputted regardless of the logic level of the signal applied to the gate terminal of the second transistor T2.

The scan signal generator 320_n further includes a fourth transistor T4, a fifth transistor T5, a sixth transistor T6, and a seventh transistor T7. According to one embodiment as illustrated in FIG. 3, the fourth to seventh transistors T4, T5, T6, and T7 are P-type MOS transistors.

The fourth transistor T4 includes a source terminal coupled with a first power source (e.g., a high power voltage) VGH, a drain terminal coupled with the gate terminal of the first transistor T1, and a gate terminal receives the frame start signal FLM.

The fifth transistor T5 includes a source terminal coupled with the drain terminal of the fourth transistor T4, a gate terminal for receiving the first initial signal INT1, and a drain terminal for receiving a voltage from a second power source (e.g., a low power voltage source) VGL. The first initial signal INT1 controls (turning on or turning off of) the fifth transistor N5. When the first initial signal INT1 is applied at a low-logic signal level, the fifth transistor T5 is turned on such that the low power voltage source VGL is applied to the first node N1.

Herein, the low power voltage source VGL and the high power voltage source VGH provide voltage of a low logic level and a high logic level, respectively.

The sixth transistor T6 includes a source terminal for receiving the voltage from the high power voltage source VGH, a gate terminal coupled with the drain terminal of the fourth transistor T4, and a drain terminal coupled with the gate terminal of the first transistor T1. A ninth transistor T9 may be further provided between the drain terminal of the sixth transistor T6 and the second node N2 as shown in FIG. 4. In FIG. 4, both the sixth and ninth transistors T6 and T9 are provided as an example. The ninth transistor T9 includes a source terminal coupled with the drain terminal of the sixth transistor T6, a gate terminal coupled with the gate terminal of the sixth transistor T6, and a drain terminal coupled with the gate terminal of the first transistor T1.

The seventh transistor T7 includes a source terminal for receiving the voltage from the high power voltage source VGH, a gate terminal coupled with the drain terminal of the fourth transistor T4, and a drain terminal coupled with the source terminal of the first transistor T1.

Further, the scan signal generator 320_n further includes the third capacitor C3. The third capacitor C3 is coupled between the high power voltage source VGH and the source terminal of the fifth transistor T5.

The boost output terminal 350_n further includes an eighth transistor T8. The eighth transistor T8 includes a source terminal for receiving the voltage from the high power voltage source VGH, a gate terminal coupled with the drain terminal of the fourth transistor T4, and a drain terminal coupled with the source terminal of the second transistor T2.

A scan signal generator 320_n−1 having an analogous structure as the scan signal generator 320_n generates an additional scan signal Scan[n−1]. The scan signal generator 320_n−1 receives the scan signal Scan[n] outputted from the adjacent scan signal generator 320_n. In the scan signal generator 320_n−1, the scan signal Scan[n] acts as a signal corresponding to the frame start signal FLM, and initiates an operation of generating the scan signal Scan[n−1] in the scan signal generator 320_n−1.

More specifically, the scan signal generator 320_n−1 located adjacent to the scan signal generator 320_n receives the scan signal Scan[n] outputted from the scan signal generator 320_n through a source terminal of a thirteenth transistor T13 and a gate terminal of a fourteenth transistor T14, similar to the scan signal generator 320_n receiving the frame start signal FLM as previously described. Further, in the scan signal generator 320_n−1, a second initial signal INT2 is applied to a gate terminal of a fifteenth transistor T15.

The first clock signal CLK1 is applied to a gate terminal of the thirteenth transistor T13. The second initial signal INT2 is applied to the gate terminal of the fifteenth transistor T15. And the second clock signal CLK2 is applied to a drain terminal of the eleventh transistor T11.

A twelfth transistor T12 of the boost output terminal 350_n−1 having substantially the same structure as the boost output terminal 350_n receives the second boost clock signal VBCLK2 at one terminal thereof (e.g., the drain terminal).

Hereinafter, referring to FIGS. 4 and 5, operations of generating the scan signal Scan[n] and the boost signal VB[n] of the scan driving apparatus 200 of FIG. 3 will be described.

Hereinafter, signals applied to or output from the first scan driving unit (e.g., 320_n) will be described.

At a time t1, the frame start signal FLM is a low-level pulse. The low-level pulse of the frame start signal FLM has the first duration P1.

At a time t2, the first initial signal INT1 transitions from a logic high to a logic low. Therefore, at the time t2, the voltage from the low power voltage source VGL is applied to the first node N1. Further, at the time t2, a voltage corresponding to a difference between the voltages of the high power voltage source VGH and the low power voltage source VGL is stored in the third capacitor C3.

At the time t1, the second clock signal CLK2 transitions from high logic to low logic.

The signals (frame start signal FLM, first and second clock signals CLK1 and CLK2, first initial signal INT1, and first boost clock signal VBCLK1) applied to the scan signal generator 320_*n*, constituted by, e.g., the P-type MOS transistors, have a low logic level as the activation level.

At the time t1, the second clock signal CLK2 is applied at the activation level, and from the time t1, the third transistor T3 is turned on during a second period P2. Therefore, the frame start signal FLM of a low logic level is transmitted to the second node N2 during the second period P2.

At the time t1, the frame start signal FLM of a low logic level is applied to the gate terminal of the fourth transistor T4. Therefore, from the time t1, the fourth transistor T4 is turned on during the first period P1. When the fourth transistor T4 is turned on, the voltage from the high power voltage source VGH is applied to the first node N1 and the gate terminals of the sixth and ninth transistors T6 and T9. As a result, the sixth and ninth transistors T6 and T9 are turned off. Further, since the high power voltage is applied to the gate terminal of the seventh transistor T7, the seventh transistor T7 is turned off. Further, since a gate terminal of the eighth transistor T8 is coupled with the gate terminal of the seventh transistor T7, the eighth transistor T8 is also turned off.

The second clock signal CLK2 is applied at a low logic level during the second period P2, such that from the time t1 to the second period P2, the frame start signal FLM of a low logic level is transmitted to the second node N2 and the gate terminal of the first transistor T1.

Here, even though the second clock signal CLK2 has a high logic level to turn off the third transistor T3, the voltage of the second node N2 is maintained at a low logic level. When the fifth transistor T5 is turned on by the first initial signal INT1 at the time t2, the voltage of a low logic level is applied to the first node N1 to turn on the seventh and eighth transistors T7 and T8. Then, the scan signal Scan[n] and the boost signal VB1[n] are maintained at a high level even after the time t2.

The voltage of the second node N2 has a high logic level in accordance with the logic level of the frame start signal FLM transmitted through the third transistor T3 at a time t3. Then, the first and second transistors T1 and T2 are turned off. Therefore, the first transistors T1 and the second transistor T2 are turned on at the time t1 and maintain a turn-on state until the time t3. Further, since the frame start signal FLM of a high logic level is applied to the gate terminal of the fourth transistor T4, the fourth transistor T4 is turned off.

When the first transistor T1 is turned on from the time t1, the first clock signal CLK1 applied to the drain terminal of the first transistor T1 is outputted from the source terminal of the first transistor T1 as the scan signal Scan[n]. Further, when the second transistor T2 is turned on, the first boost clock signal VBCLK1 applied to the drain terminal of the second transistor T2 is outputted from the source terminal of the second transistor T2 as the boost signal VB[n].

The first boost clock signal VBCLK1 is a signal that is delayed from the first clock signal CLK1 by the third period P3. The third period P3 may be set by a user.

Until the time t1, the first node N1 is maintained at the voltage of the low power voltage source VGL. Therefore, before the time t1, the signal of a low logic level is applied to the gate terminals of the sixth, seventh, and eighth transistors T6, T7, and T8. As a result, the sixth, seventh, and eighth transistors T6, T7, and T8 are all turned on, such that the voltage of the high power voltage source VGH is applied to the second node N2. Further, the scan signal Scan[n] and the boost signal VB[n] are outputted at a high logic level.

Further, the scan signal Scan[n] outputted from the n-th scan signal generator 320_*n* is applied to the n−1-th scan signal generator 320_*n*−1 as shown in FIGS. 3 and 4.

The first clock signal CLK1 and the second clock signal CLK2 have the same period P6 and the first clock signal CLK1 and the second clock signal CLK2 have a phase difference of a half-period P7. The first initial signal INT1 and the second initial signal INT2 have the same period P4, and the second initial signal INT2 and the first initial signal INT1 have a phase difference of a half-period P5.

The first boost clock signal VBCLK1 and the second boost clock signal VBCLK2 have the same period P8, and the first boost clock signal VBCLK1 and the second boost clock signal VBCLK2 have a phase difference of a half-period P9. Further, the periods P6, P4, and P8 are substantially the same duration.

Signals applied to and outputted from the second scan driving unit (e.g., 320_*n*−1) will now be described.

The thirteenth transistor T13 receives the scan signal Scan[n] at the source terminal thereof and receives the first clock signal CLK1 at the gate terminal thereof. At the time t5, since the scan signal Scan[n] and the first clock signal CLK1 are of a low logic level, the scan signal Scan[n] of a low logic level is transmitted to the gate terminal of the eleventh transistor T11 at the time t5. As a result, from the time t5, the eleventh transistor T11 outputs the second clock signal CLK2 applied to the drain terminal as the scan signal Scan[n−1]. The scan signal Scan[n−1] is outputted through the source terminal of the eleventh transistor T11. Therefore, after the fifth time t5, the scan signal Scan[n−1] has the same logic level as the second clock signal CLK2. That is, the scan signal Scan[n−1] is transitioned to a low logic level from a high logic level at the seventh time t7, similar to the second clock signal CLK2.

In addition, at the fifth time t5, the scan signal Scan[n] of a low logic level is transmitted to the gate terminal of the twelfth transistor T12. As a result, from the fifth time t5, the twelfth transistor T12 outputs the second boost clock signal VBCLK2 applied to the drain terminal as the boost signal VB[n−1]. The boost signal VB[n−1] is outputted through the source terminal of the twelfth transistor T12. Therefore, after the fifth time t5, the boost signal VB[n−1] has the same logic level as the second boost clock signal VBCLK2.

Other signals applied to and outputted from the second scan driving unit (e.g., 320_*n*−1) are substantially the same as the signals applied to and outputted from the first scan driving unit (e.g., 320_*n*). Therefore, a detailed description will be omitted.

Each of the plurality of scan driving units included in the scan driving apparatus according to an exemplary embodiment includes the scan signal generator (e.g., 320_*n*) and the boost output terminal (e.g., 350_*n*) that is coupled with an output terminal of the scan signal generator 320_*n* and is constituted by two transistors T2 and T8 to generate both the scan signal (e.g., Scan[n]) and the boost signal (e.g., VB[n]). As a result, the additional boost driver can be eliminated and the configuration of the driver circuit is simplified to reduce the dimensions of the driver (e.g., the size).

Figure 6:
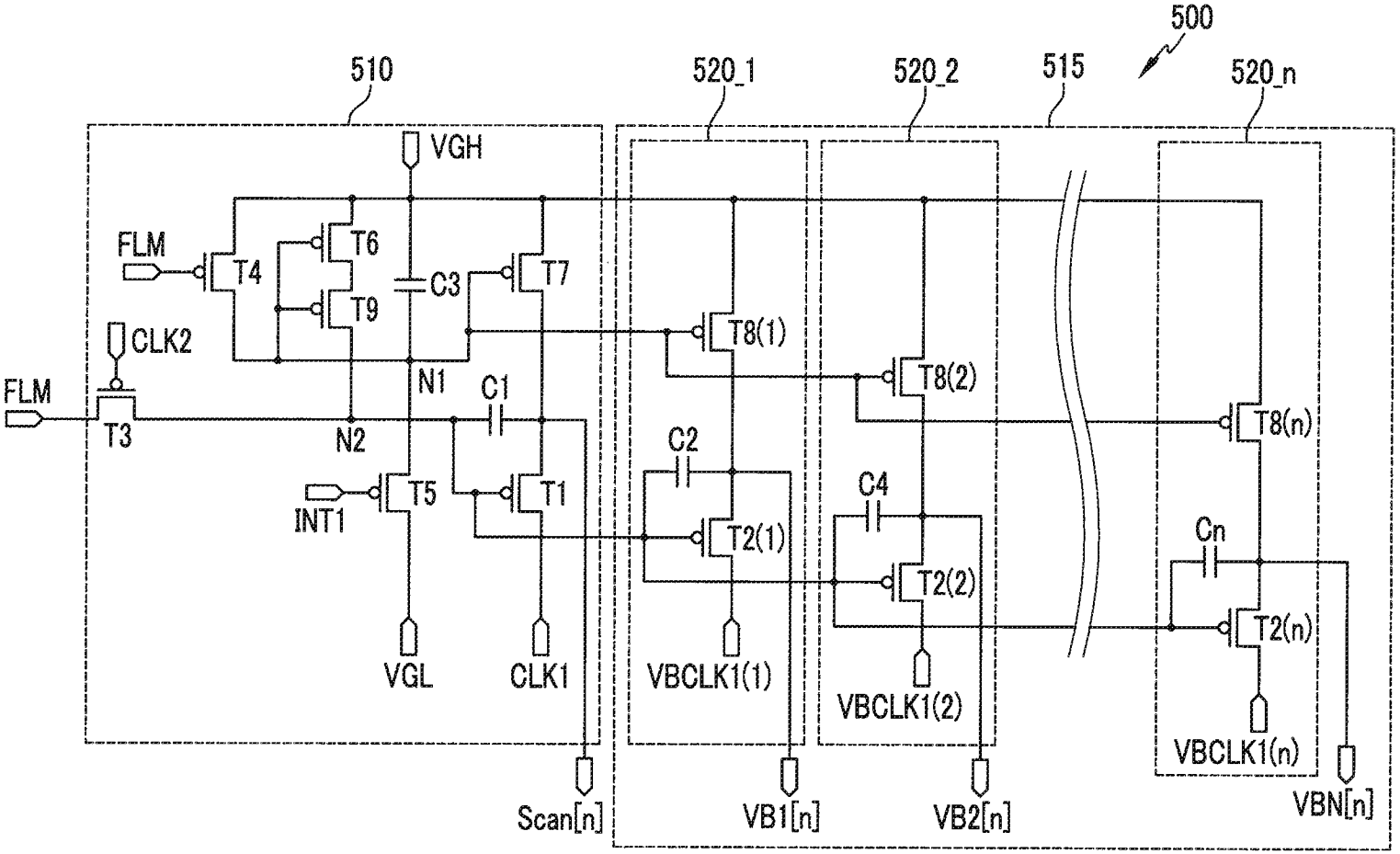
FIG. 6 is a diagram illustrating a scan driving apparatus according to another exemplary embodiment of the present invention.

FIG. 6 is a diagram illustrating a scan driving apparatus according to another exemplary embodiment of the present invention.

A scan driving apparatus 500, includes a scan signal generator 510 and a boost signal generator 515. The boost signal generator 515 includes first to n-th boost output terminals 520_1 to 520_*n*. FIG. 6 shows only three boost output terminals 520_1, 520_2, and 520_*n*, and for brevity, the other boost output terminals are not shown. The first to n-th boost output terminals 520_1 to 520_*n* are coupled in a cascade as shown in FIG. 6.

The scan driving apparatus 500 according to an embodiment of the present invention further includes a plurality of boost output terminals 520_2 and 520_*n*, in comparison with the scan driving unit 310_*n* of FIG. 4. The scan signal generator 510 and the first boost output terminal 520_1 of FIG. 6 can be similarly configured to the scan signal generator 320_*n* of FIG. 4 and the boost output terminal 350_*n* in components and connection relationships between the components.

The plurality of boost output terminals 520_1, 520_2, and 520_*n* are substantially the same in terms of components and circuit operation. Each of the second to n-th boost output terminals 520_1 to 520_*n* includes a second transistor T2(*i*). Further, each output terminal further includes an eighth transistor T8(*i*).

The first to n-th boost output terminals 520_1 to 520_*n* receives first to n-th boost clock signals VBCLK1(1) to VBCLK1(*n*). In addition, the first to n-th boost output terminals 520_1 to 520_*n* outputs first to n-th boost signals VB1(*n*) to VBN(n). The gate terminal of the second transistor T2(*i*) of each of the first to n-th boost output terminals 520_1 to 520_*n* is coupled with the gate terminal of the first transistor T1.

Since operation of each of the first to n-th boost output terminals 520_1 to 520_*n* is substantially the same as operation of the boost output terminal 350_*n* of FIG. 4, a detailed description thereof is omitted for brevity.

Figure 7:
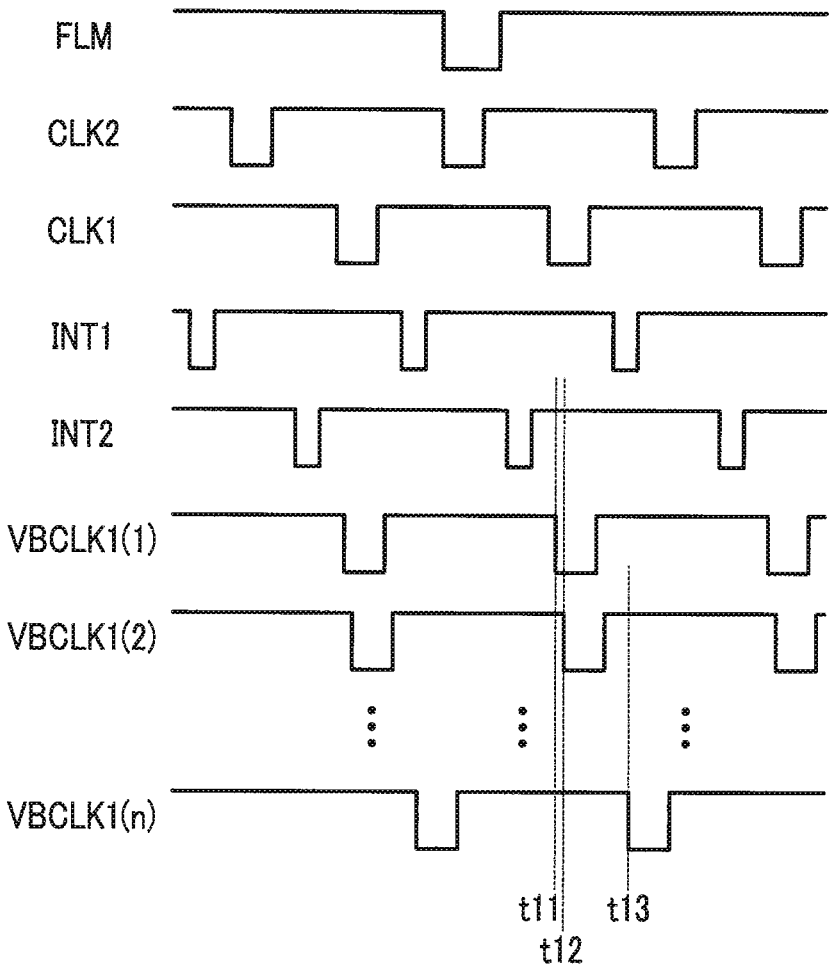
FIG. 7 is a timing diagram of signals for a scan driving apparatus as illustrated in FIG. 6.

FIG. 7 is a timing diagram of signals for a scan driving apparatus as illustrated in FIG. 6.

Each of the first boost clock signal VBCLK1(1) applied to the first boost output terminal 520_1, the second boost clock signal VBCLK1(2) applied to the second boost output terminal 520_2, and the n-th boost clock signal VBCLK1(*n*) is applied at low logic level at times t11, t12, and t13, respectively. Herein, the i-th boost clock signal (e.g., VBCLK1(1)) is set to be applied earlier than the i−1-th boost clock signal (e.g., VBCLK1(2)) by a time t12-t11. Further, a detailed value of the time interval t12-t11 may be set by the user.

Further, similar to the first boost clock signal VBCLK1 and the boost signal VB[n] shown in FIG. 5 being outputted while having substantially the same pulse waveform, the first boost signal VB1[n], the second boost signal VB2[n], and the n-th boost signal VBN[n] are outputted while having substantially the same pulse waveform as the first boost clock signal VBCLK1(1), the second boost clock signal VBCLK1(2), and the n-th boost clock signal VBCLK1(*n*). The other signals are substantially the same as in FIG. 5. Therefore, a detailed description thereof will be omitted for brevity.

The scan driving apparatus 500 according to one embodiment can include a plurality of boost output terminals that are coupled with each other (e.g. cascaded) to generate the scan signals and the plurality of boost signals in one scan driving apparatus. While certain exemplary embodiments of the present invention have been described, it is to be understood that the invention is not limited to the disclosed embodiments, but, on the contrary, is intended to cover various modifications and equivalent arrangements included within the spirit and scope of the appended claims and their equivalents.

What is claimed is:

1. A scan driving apparatus comprising:

a first scan driving unit configured to receive a first start signal, a first clock signal, a second clock signal, and a first boost clock signal, to sequentially output the first clock signal as a first scan signal having a first period in accordance with the first start signal applied in response to the second clock signal, and to sequentially output the first boost clock signal as a first boost signal having the first period, wherein the first scan signal changes from a first logic level to a second logic level at a start time of the first period of the first scan signal, and wherein the first boost signal changes from the first logic level to the second logic level at a start time of the first period of the first boost signal, wherein the start time of the first period of the first boost signal is delayed from the start time of the first period of the first scan signal, and wherein an end time of the first period of the first boost signal is delayed from an end time of the first period of the first scan signal; and a second scan driving unit coupled to the first scan driving unit, the second scan driving unit configured to receive the first clock signal, the second clock signal, a second boost clock signal, and the first scan signal as a second start signal, to sequentially output the second clock signal as a second scan signal having a second period in accordance with the second start signal applied in response to the first clock signal, and to sequentially output the second boost clock signal as a second boost signal having the second period.

2. The scan driving apparatus of claim 1, wherein the first scan driving unit comprises:

a scan signal generator configured to receive the first clock signal and the second clock signal and output the first clock signal as the first scan signal in accordance with the first start signal applied by the second clock signal; and a boost output terminal configured to receive the first boost clock signal and output the first boost clock signal as the first boost signal in accordance with the first start signal applied in response to the second clock signal.

3. The scan driving apparatus of claim 2, wherein the scan signal generator of the first scan driving unit comprises:

a first transistor comprising a first terminal for receiving the first clock signal, a gate terminal for receiving the first start signal, and a second terminal for outputting the first scan signal;

a first capacitor coupled between the gate terminal of the first transistor and the second terminal of the first transistor; and a second transistor comprising a first terminal coupled with the gate terminal of the first transistor, a gate terminal for receiving the second clock signal, and a second terminal for receiving the first start signal, and the boost output terminal of the first scan driving unit comprises:

a third transistor comprising a first terminal for receiving the first boost clock signal, a gate terminal coupled to the gate terminal of the first transistor, and a second terminal for outputting the first boost clock signal; and a second capacitor coupled between the gate terminal of the third transistor and the second terminal of the third transistor.

4. The scan driving apparatus of claim 3, wherein the scan signal generator of the first scan driving unit further comprises:

a fourth transistor comprising a first terminal coupled with a first power source, a gate terminal, and a second terminal coupled with the second terminal of the first transistor; and a fifth transistor comprising a first terminal coupled with the gate terminal of the fourth transistor, a gate terminal for receiving a first initial signal, and a second terminal coupled with a second power source, wherein the first power source is configured to generate a higher voltage level than the second power source, and the boost output terminal of the first scan driving unit further comprises a sixth transistor comprising a first terminal coupled with the first power source, a gate terminal coupled with the first terminal of the fifth transistor, and the second terminal coupled with the second terminal of the third transistor.

5. The scan driving apparatus of claim 4, wherein the first initial signal becomes a pulse of an activation level before the first start signal becomes a pulse of an activation level.

6. The scan driving apparatus of claim 4, wherein the scan signal generator of the first scan driving unit further comprises:

a seventh transistor comprising a first terminal coupled with the first power source, a gate terminal for receiving the first start signal, and a second terminal coupled with the first terminal of the fifth transistor; an eighth transistor comprising a first terminal coupled with the first power source, a second terminal, and a gate terminal coupled with the second terminal of the seventh transistor; and a ninth transistor comprising a first terminal coupled with the second terminal of the eighth transistor, a gate terminal coupled with the gate terminal of the eighth transistor, and a second terminal coupled with the gate terminal of the first transistor.

7. The scan driving apparatus of claim 1, wherein the second scan driving unit comprises:

a scan signal generator for receiving the first clock signal, and the second clock signal, and for outputting the second clock signal as the second scan signal in accordance with the second start signal applied in response to the first clock signal; and a boost output terminal for receiving the second boost clock signal and for outputting the second boost clock signal as the second boost signal in accordance with the second start signal applied in response to the first clock signal.

8. The scan driving apparatus of claim 7, wherein the scan signal generator of the second scan driving unit comprises:

a tenth transistor comprising a first terminal for receiving the second clock signal, a gate terminal for receiving the second start signal according to the first clock signal, and a second terminal for outputting the second scan signal;

a third capacitor coupled with the gate terminal and the second terminal of the tenth transistor; and an eleventh transistor comprising a first terminal coupled with the gate terminal of the tenth transistor, a gate terminal for receiving the first clock signal, and the second terminal for receiving the second start signal, and the boost output terminal of the second scan driving unit comprises:

a twelfth transistor comprising a first terminal for receiving the second boost clock signal, a gate terminal for receiving the second start signal applied by the first clock signal, and a second terminal configured to output the second boost clock signal; and a fourth capacitor coupled with the gate terminal and the second terminal of the twelfth transistor.

9. The scan driving apparatus of claim 8, wherein the scan signal generator of the second scan driving unit further comprises:

a thirteenth transistor comprising a first terminal coupled with the first power source and a second terminal coupled to the second terminal of the tenth transistor; and a fourteenth transistor comprising a first terminal coupled with the gate terminal of the thirteenth transistor, a gate terminal for receiving a second initial signal, and a second terminal coupled with the second power source; and the boost output terminal of the second scan driving unit further comprises a fifteenth transistor comprising a first terminal coupled with the first power source, a gate terminal coupled with the first terminal of the fourteenth transistor, and a second terminal coupled with the second terminal of the twelfth transistor.

10. The scan driving apparatus of claim 9, wherein the second initial signal becomes a pulse of an activation level before the second start signal becomes a pulse of an activation level.

11. The scan driving apparatus of claim 9, wherein the scan signal generator of the second scan driving unit further comprises:

a sixteenth transistor comprising a first terminal coupled with the first power source, a gate terminal for receiving the second start signal, and a second terminal coupled with the first terminal of the fourteenth transistor;

a seventeenth transistor comprising a first terminal coupled with the first power source, a second terminal, and a gate terminal coupled with the second terminal of the sixteenth transistor; and an eighteenth transistor comprising a first terminal coupled with the second terminal of the seventeenth transistor, a gate terminal coupled with the gate terminal of the seventeenth transistor, and a second terminal coupled with the gate terminal of the tenth transistor.

12. The scan driving apparatus of claim 1, wherein, the first scan signal is a frame start signal which is applied to display an image of one frame.

13. The scan driving apparatus of claim 1, wherein the first boost clock signal is delayed from the first clock signal by a first time period.

14. The scan driving apparatus of claim 13, wherein the first period is set by a user.

* * * * *